United States Patent [19]

Sakaki et al.

[11] Patent Number: 4,540,355

[45] Date of Patent: Sep. 10, 1985

[54] AXIAL SEALING DEVICE FOR A SCROLL-TYPE FLUID DISPLACEMENT APPARATUS

[75] Inventors: Masakatsu Sakaki, Isesaki; Masaharu Hiraga, Honjo, both of Japan

[73] Assignee: Sanden Corporation, Japan

[21] Appl. No.: 588,401

[22] Filed: Mar. 12, 1984

[30] Foreign Application Priority Data

Mar. 15, 1983 [JP] Japan ..... 58-36345[U]

[51] Int. Cl.[3] ..... F01C 1/04; F01C 19/08; F01C 21/00

[52] U.S. Cl. ..... 418/55; 418/142; 418/178

[58] Field of Search ..... 418/55, 142, 178; 277/204, 236, 237

[56] References Cited

U.S. PATENT DOCUMENTS

| | | | |
|---|---|---|---|
| 994,391 | 6/1911 | Haver . | |
| 3,313,239 | 4/1967 | Brunson et al. | 418/178 |
| 3,361,074 | 1/1968 | Eckerle . | |
| 3,680,990 | 8/1972 | Pettibone et al. | 418/178 |
| 3,887,310 | 6/1975 | Gerber . | |
| 3,986,799 | 10/1976 | McCullough | 418/55 |
| 4,047,855 | 9/1977 | Goloff et al. . | |

FOREIGN PATENT DOCUMENTS

| | | | |
|---|---|---|---|
| 12615 | 6/1980 | European Pat. Off. | 418/55 |
| 60496 | 9/1982 | European Pat. Off. | 418/55 |
| 55-35155 | 3/1980 | Japan | 418/178 |
| 57-148088 | 9/1982 | Japan | 418/55 |

*Primary Examiner*—John J. Vrablik

*Attorney, Agent, or Firm*—Banner, Birch, McKie & Beckett

[57] ABSTRACT

A scroll-type fluid displacement apparatus is disclosed having a pair of scroll members each comprising an end plate and a spiral wrap extending from one side of the end plate. The spiral wraps interfit at an angular and radial offset to make a plurality of line contacts to define at least one pair of sealed-off fluid pockets. At least one of the scroll members has a discharge port or fluid hole near the center of the spiral element and is provided with an anti-wear plate on its end surface facing the other scroll member. The anti-wear plate is an involute plate that covers substantially the area of the end surface of the end plate on which the spiral wrap of the other scroll member makes contact during the orbital motion of the orbiting scroll member. The radially inner end of the anti-wear plate is spaced from the discharge port to avoid blocking the discharge flow or covering the discharge port. Therefore, the undesirable vibration of the anti-wear plate by fluid flowing through the port is avoided.

6 Claims, 5 Drawing Figures

AXIAL SEALING DEVICE FOR A SCROLL-TYPE FLUID DISPLACEMENT APPARATUS

BACKGROUND OF THE INVENTION

This invention relates to fluid displacement apparatus and, more particularly, to an improved axial sealing device for a scroll-type fluid compressor.

Scroll-type apparatus are well-known in the prior art. For example, U.S. Pat. No. 801,182 discloses the basic construction of a scroll-type fluid displacement apparatus that includes two scroll members, each having a circular end plate and a spiroidal or involute spiral element. These scroll members are maintained angularly and radially offset so that the spiral elements interfit to make a plurality of line contacts between their spiral curved surfaces, which define and seal off at least one pair of fluid pockets. The fluid pockets are defined by the line contacts between the interfitting two spiral elements and the axial contacts between the axial end surface of one spiral element and the inner end surface of the end plate supporting the other spiral element. The relative orbital motion of the two scroll members shifts the line contacts along the spiral curved surface, thus changing the volume of the fluid pockets. Since the volume of the fluid pockets increases or decreases dependent on the direction of the orbital motion, the scroll-type fluid displacement apparatus is applicable to compress, expand, or pump fluids.

In comparison with conventional compressors of the piston type, the scroll-type compressor has certain advantages, such as fewer parts and continuous compression of fluid. However, one of the problems with scroll-type compressors is the ineffective sealing of the fluid pockets. Axial and radial sealing of the fluid pockets must be maintained in a scroll-type compressor in order to achieve efficient operation.

Various techniques have been used in the prior art to resolve the sealing problems, in particular, the axial sealing problem. In U.S. Pat. No. 3,334,634, a seal element is mounted on the axial end surface of each spiral element. The end surface of each spiral element facing the end plate of the other scroll member is provided with a groove along the spiral. The seal element is placed within each of the grooves together with an axial force-urging means, such as a spring. The axial force-urging means urges the seal element toward the facing end surface of the end plate to thereby effect the axial sealing.

Because the seal element in the above-cited patent is urged toward the facing end surface of the end plate by a spring or other axial force-urging mechanism, over a period of time abrasions occur between the end surface of the seal element and the end plate of the scroll member, especially when lightweight alloys such as aluminum alloys are used for the material of the scroll member. These abrasions result in undesirable wear and create tiny abrasion particles or dust. The wear creates damage to the parts of the apparatus (e.g., to the surface of the scroll members). When the scroll device is used as the compressor in an air-conditioning system, for example, the abrasion particles adversely affect the operation of the filter and expansion valve for the refrigerant circuit. As the end plate wears because of abrasion, the seal elements are also damaged, and the axial contact between the end surface of spiral element and the inner end surface of the end plate becomes imperfect, which dimishes compressor efficiency.

To avoid these disadvantages, an improved axial sealing device is described in commonly assigned co-pending application Ser. No. 312,755 filed on Oct. 19, 1981. In this application, an involute anti-wear plate is disposed between the axial end surface of the seal element and the circular end plate of one or both scrolls. However, one of the scrolls, preferably the fixed scroll, must have a discharge port at or near the center of the spiral element and end plate. Therefore, if an anti-wear plate is disposed on the scroll which has the discharge port, the center portion of the anti-wear plate constructed as disclosed in the above-cited co-pending application covers or partly covers the discharge port. It has been found that during the operation of a scroll device so constructed, the fluid passing through the discharge port strikes against the center of the anti-wear plate and causes undesirable vibration of the plate which may result in breakage or damage to the central portion of the plate.

SUMMARY OF THE INVENTION

It is a primary object of this invention to provide an efficient scroll-type fluid displacement apparatus.

It is another object of this invention provide a scroll-type fluid displacement apparatus, particularly a scroll-type fluid compressor, wherein the axial contact and axial sealing between spiral element and end plate is improved.

It is still another object of this invention to provide a scroll-type fluid displacement apparatus having an axial sealing device which prevents wear or damage to the scroll member.

It is a further object of this invention to provide a scroll-type fluid displacement apparatus that has a long useful life.

It is another object of this invention to provide a scroll-type fluid displacement apparatus that is light in weight.

It is another object of this invention to realize the above objects with a simple construction that can be simply manufactured at low cost.

A scroll-type fluid displacement apparatus according to this invention includes a pair of scroll members, each comprising an end plate and a spiral wrap extending from one side of the end plate. The spiral wraps interfit to define variable fluid pockets by making a plurality of line contacts between the spiral curved surfaces of the sprial wraps. These spiral wraps are angularly and radially offset. A driving mechanism includes a drive shaft which is rotatably supported by a housing and operatively connected to one of the scroll members to cause the one scroll member to undergo orbital motion relative to the other scroll member, while preventing rotation of the one orbiting scroll member. The relative orbital motion of the scroll members changes the volume of the fluid pockets.

In order to effectively change the volume of the fluid pockets, the fluid displacement apparatus must provide axial and radial sealing between the scroll members. The axial sealing is more critical. To achieve effective axial sealing, involute-shaped sealing elements are used on the end surface of the spiral wraps of one scroll member which sealingly engage the facing end plate of the other scroll member. However, since the scroll members generally are formed of an aluminum alloy to reduce the weight of the apparatus, the softness of the aluminum alloy results in considerable abrasion and wear between the end plates and axial seal elements over a period of time. To minimize wear, while at the same time achieving effective axial sealing, the present invention provides an involute plate formed of a hard material, such as steel, between the axial end surface of the seal element on the spiral wrap of one scroll member and the circular end plate of the other scroll member. This involute plate covers substantially only the area of the surface of the circular end plate of the one scroll member where the spiral wrap and seal element make axial contact during the orbital motion of the orbiting scroll member, thus providing a hardened sealing surface for the seal element and thereby preventing excessive wear and abrasion. Furthermore, the central portion of the involute plate is formed with a cut-out portion or with a radially inner end shaped such that the discharge port of the scroll member is not blocked by the involute plate.

Further objects, features and other aspects of this invention will be understood from the following detailed description of the preferred embodiments of this invention, referring to the annexed drawings.

BRIEF DESCRIPTION OF THE DRAWING

FIG. 2(*b*) is a front view of an involute anti-wear plate member according to the invention.

DETAILED DESCRIPTION OF THE PREFERRED EMBODIMENTS

Figure 1:
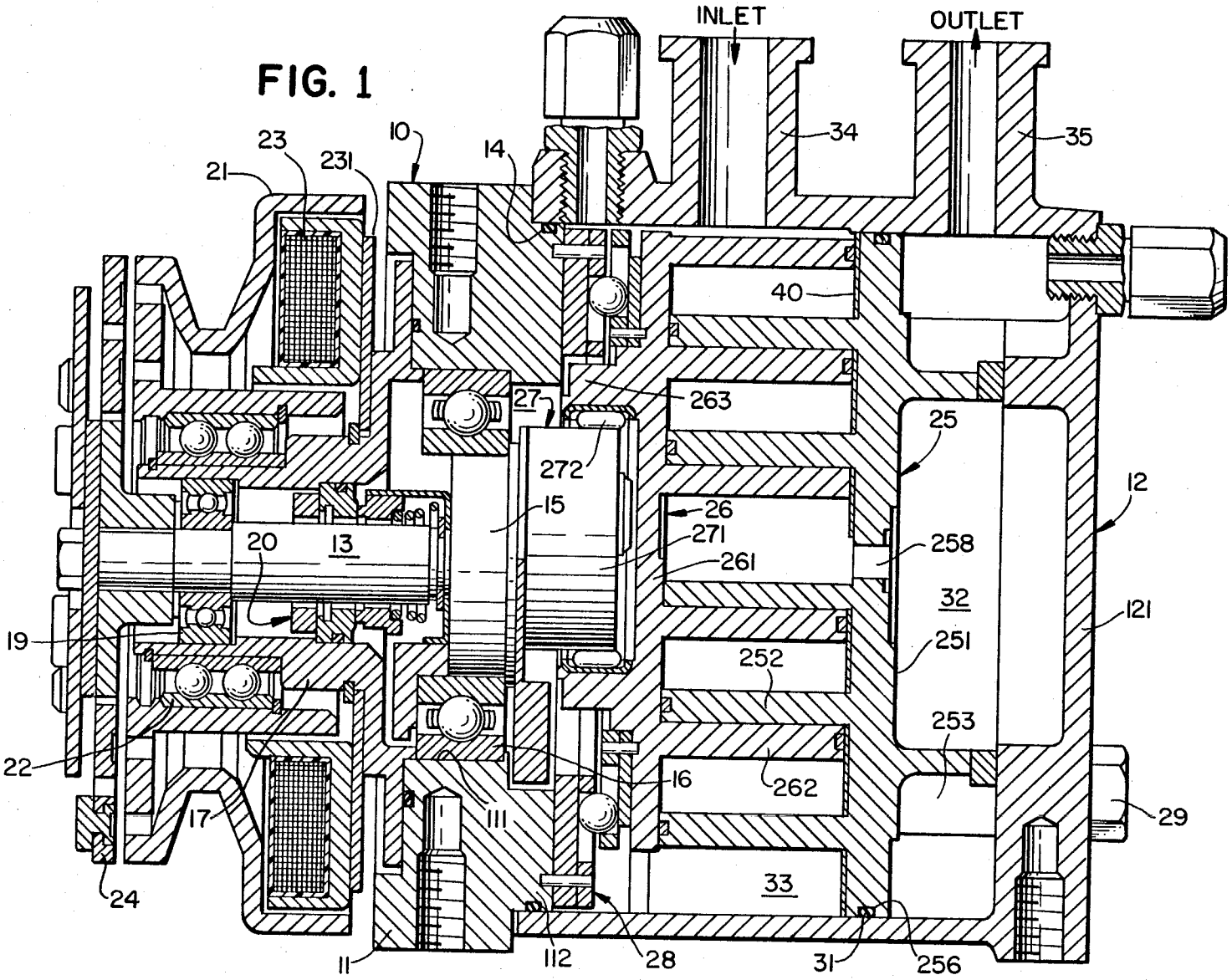
FIG. 1 is a vertical sectional view of a scroll-type compressor according to one embodiment of this invention.

With reference to FIG. 1, a scroll-type refrigerant compressor in accordance with the present invention is shown. The compressor includes a compressor housing 10 having a front end plate 11 and a cup-shaped casing 12 fastened to an end surface of front end plate 11. An opening 111 is formed in the center of front end plate 11 for supporting drive shaft 13. An annular projection 112, concentric with opening 111, is formed on the rear end surface of front end plate 11 facing cup-shaped casing 12. An outer peripheral surface of annular projection 112 fits into an inner surface of the opening of cup-shaped casing 12. Cup-shaped casing 12 is fixed on the rear end surface of front end plate 111 by a fastening device, so that the opening of cup-shaped casing 12 is covered by front end plate 111. An O-ring 14 is placed between the outer surface of annular projection 112 and the inner surface of the opening of cup-shaped casing 12 to seal the mating surface of front end plate 11 and cup-shaped casing 12. Front end plate 11 has an annular sleeve 17 projecting from the front end surface thereof. Sleeve 17 surrounds drive shaft 13 to define a shaft seal cavity. As shown in FIG. 1, sleeve 17 is attached to the front end surface of front end plate 11 by screws. Alternatively, sleeve 17 may be formed integral with front end plate 11.

Drive shaft 13 is rotatably supported by sleeve 17 through a bearing 19 disposed within the front end of sleeve 17. Drive shaft 13 has a disk-shaped rotor 15 at its inner end. Disk shaped rotor 15 is rotatably supported by front end plate 11 through a bearing 16 disposed within opening 111 of front end plate 11. A shaft seal assembly 20 is assembled on drive shaft 13 within the shaft seal cavity of sleeve 17.

A pulley 21 is rotatably supported on the outer surface of sleeve 17 through a bearing 22. An electromagnetic annular coil 23 is mounted on the outer surface of sleeve 17 through supported plate 231, which is received in an annular cavity of pulley 22. An armature plate 24 is elastically supported on the outer end of drive shaft 13, which extends from sleeve 17. A magnetic clutch is thus formed by pulley 22, magnetic coil 23, and armature plate 24. Therefore, drive shaft 13 is driven by an external power source, for example, an engine of a vehicle, through a rotation transmitting device, such as the above-described magnetic clutch.

The inner chamber of cup-shaped casing 12 includes the space between the inner wall of cup-shaped casing 12 and the inner surface of front end plate 11. A number of elements are located within the inner chamber of cup-shaped casing 12 including a fixed scroll 25, an orbiting scroll 26, a driving mechanism for orbiting scroll 26 and a rotation-preventing/thrust-bearing mechanism 28 for orbiting scroll 26.

Fixed scroll 25 includes a circular end plate 251, wrap or spiral element 252 affixed to or extending from one end surface of circular end plate 251, and a plurality of internally threaded bosses 253 axially projecting from the other end surface of circular end plate 251 on the side opposite spiral element 252. An axial end surface of each boss 253 abuts an inner surface of end plate 121 of cup-shaped casing 12. Fixed scroll 25 is fixed to end plate 121 of cup-shaped casing 12 by bolts 29, which are shown in FIG. 1. Circular end plate 251 of fixed scroll 25 partitions the inner chamber of cup-shaped casing 12 into a rear chamber 32 and a front chamber 33 in which spiral element 252 of fixed scroll 25 is located. A sealing element 31 is disposed within circumferential groove 256 of circular end plate 251 for sealing the outer peripheral surace of end plate 251 and the inner wall of cup-shaped casing 12. A hole or discharge port 258 is formed through circular end plate 251 at a position near the center of spiral element 252. Discharge port 258 connects the fluid pocket at the center of spiral element 252 and rear chamber 32.

Orbiting scroll 26, which is disposed in front chamber 33, includes a circular end plate 261 and a wrap or spiral element 262 affixed to or extending from one end surface of circular end plate 261. The spiral elements 252 and 262 interfit at an angular offset of 180° and a predetermined radial offset. The spiral elements define at least a pair of fluid pockets between their interfitting surfaces. Orbiting scroll 26 is connected to the driving mechanism 27 and the rotation-preventing/thrust-bearing mechanism 28. These two mechanisms effect the orbital motion of orbiting scroll 26 by rotation of drive shaft 13 to thereby compress fluid passing through the compressor, as described below.

The driving mechanism 27 for orbiting scroll 26 includes drive shaft 13 and disk-shaped rotor 15. A crank pin (not shown) eccentrically projects from an axial end surface of disk-shaped rotor 15. Orbiting scroll 26 is rotatably supported on a bushing 271 which fits into boss 263 axially projecting from the other end surface of end plate 261 of fixed scroll 26 through a bearing 272. Bushing 271 is rotatably supported on the crank pin. Thus orbiting scroll 26 is rotatably supported on the crank pin of drive shaft 13. Therefore, bushing 271 is driven by revolution of the drive shaft. Furthermore, the rotation of orbiting scroll 26 is prevented by rotation-preventing/thrust-bearing mechanism 28, which is placed between the inner wall of the housing and circular end plate 261 of orbiting scroll 26. As a result, orbiting scroll 26 orbits while maintaining its angular orientation relative to fixed scroll 25.

As orbiting scroll 26 orbits, the line contacts between spiral elements 252 and 262 shift toward the center of the sprial elements along the surfaces of the spiral elements. The fluid pockets defined by the line contacts between spiral elements 252 and 262 move toward the center with a consequent reduction of volume to thereby compress the fluid in the fluid pockets. Therefore, fluid or refrigerant gas introduced into front chamber 33 from an external fluid circuit through inlet port 34 mounted on the outside of cup-shaped casing 12 is taken into the fluid pockets formed at the outer portion of spiral elements 252 and 262. As orbiting scroll 26 orbits, the fluid in the pockets is compressed as the pockets move toward the center of the spiral element. Finally, the compressed fluid is discharged to the external fluid circuit through outlet port 35 formed on cup-shaped casing 12.

Figure 2A:
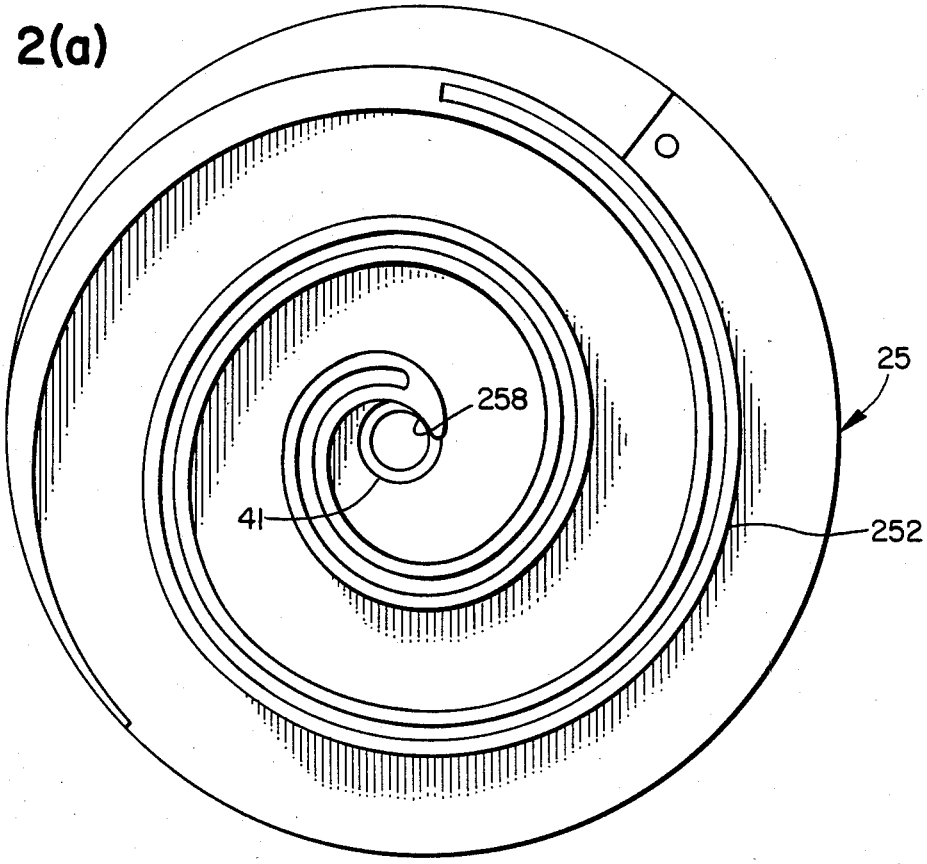
FIG. 2(*a*) is a front view of a fixed scroll of the compressor shown in FIG. 1.
Figure 2B:
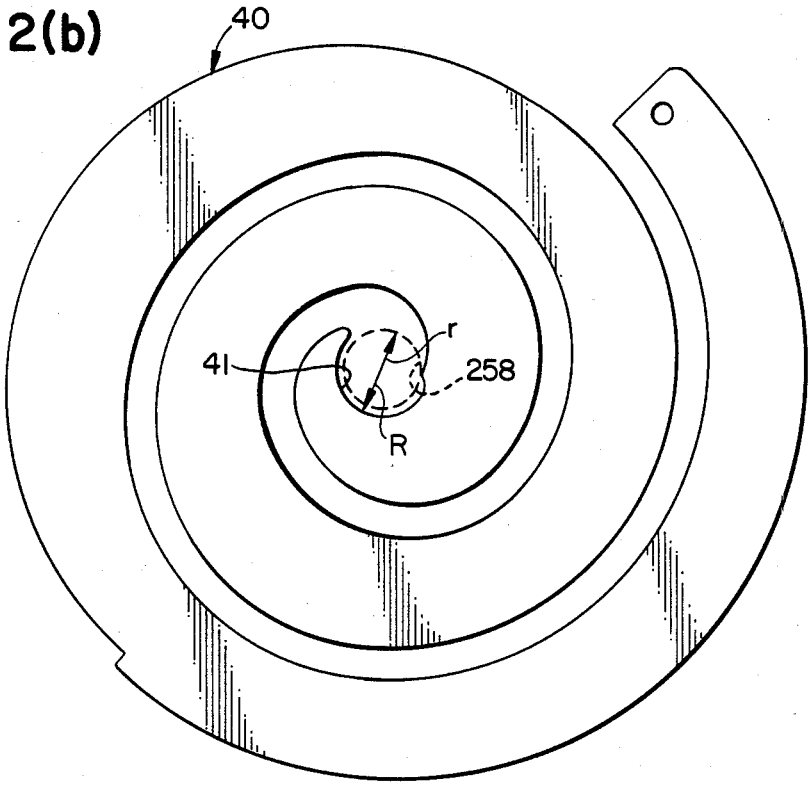

In the above-described construction, both spiral elements 252 and 262, as shown in FIG. 1, have a groove on their axial end surface and, further, have seal elements within the groove for providing a seal between the inner surface of each circular end plate and the axial end surface of each spiral element. Involute plate 40, shown in FIG. 2(*b*), which is formed of a hard, wear-resistant material, such as hardened steel, is fitted to the end surface of one or both end plates. As shown in the drawings, wear involute plate 40 is shown fixed to stationary circular end plate 252 facing orbiting scroll 26. The radial inner portion of involute plate 40 terminates adjacent discharge port 258 of fixed scroll 25. It is important to ensure that involute plate 40 does not cover or otherwise block discharge port 258. Accordingly, the inner radial end of involute plate 40 adjacent discharge port 258 has a cut-out portion 41. In the embodiment shown in FIG. 2(*b*), cut-out portion 41 is defined by the arc of a circle having a radius R, which is larger than the radius r of discharge port 258. Therefore, the edge of cut-out portion 41 of involute plate 40 is spaced from the periphery of discharge port 258. The distance between the edge of cut-out portion 41 of involute plate 40 and the edge of hole 258 is preferably at least the thickness of involute plate 40.

Figure 3:
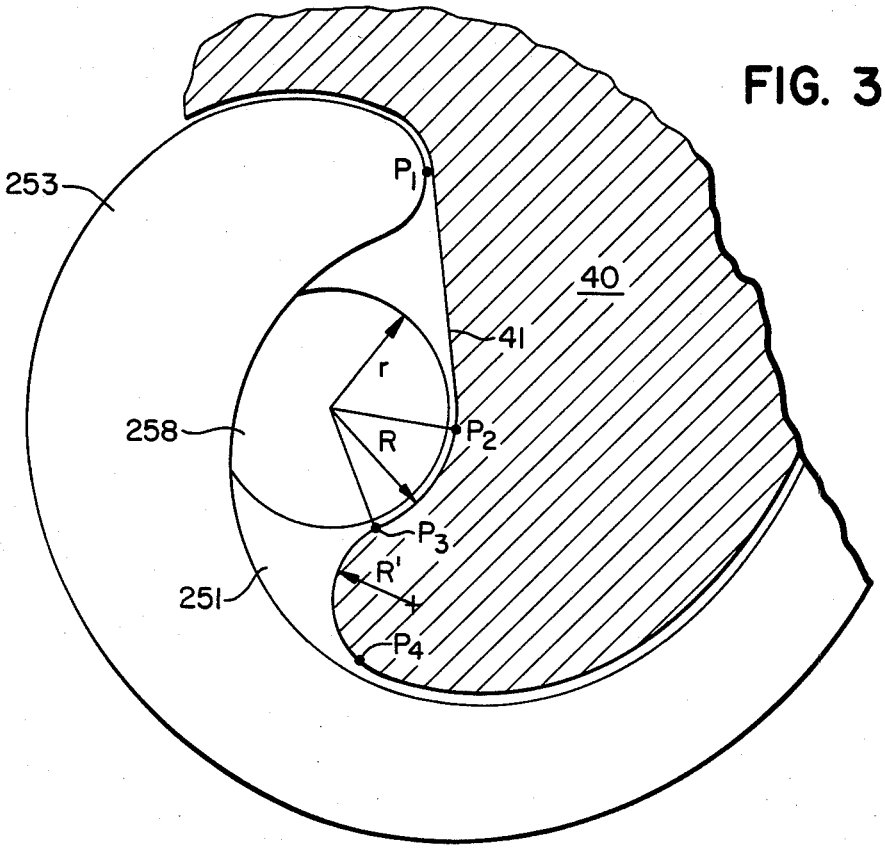
FIGS. 3 and 4 are diagrammatic views of a part of a spiral element of a scroll compressor illustrating the configuration of an involute anti-wear plate member according to other embodiments of the invention.

In FIG. 3, another embodiment is shown which is directed to a modified configuration of the radially inner end of involute plate 40. In this embodiment, one segment of cut-out portion 41A of involute plate 40 is defined by line $P_1$–$P_2$, which is a tangent line of an arc $P_2$–$P_3$, having a radius R centered at the center C of discharge port 258. Point $P_1$ is a point at the radially innermost end of sprial wrap 252. Point $P_2$ is located on the arc of radius R, as shown in FIG. 3. A second segment of cut-out portion 41A is defined between the points $P_2$ and $P_3$, which are located on the periphery of the arc of radius R as described above. A third segment of cut-out portion 41A is defined by an arc $P_3$–$P_4$ of radius R′, centered at a point X on involute plate 40. Point $P_4$ is located on the outer wall of involute plate 40 on an involute curve corresponding in shape to the inner wall of spiral element 252. Point $P_3$ lies at the intersection of arc $P_2$–$P_3$, having radius R centered at C, and arc $P_3$–$P_4$, having a radius R′ centered at X. The remainder of involute plate 40 conforms to the shape of spiral wrap 252, but is spaced inwardly therefrom.

Figure 4:
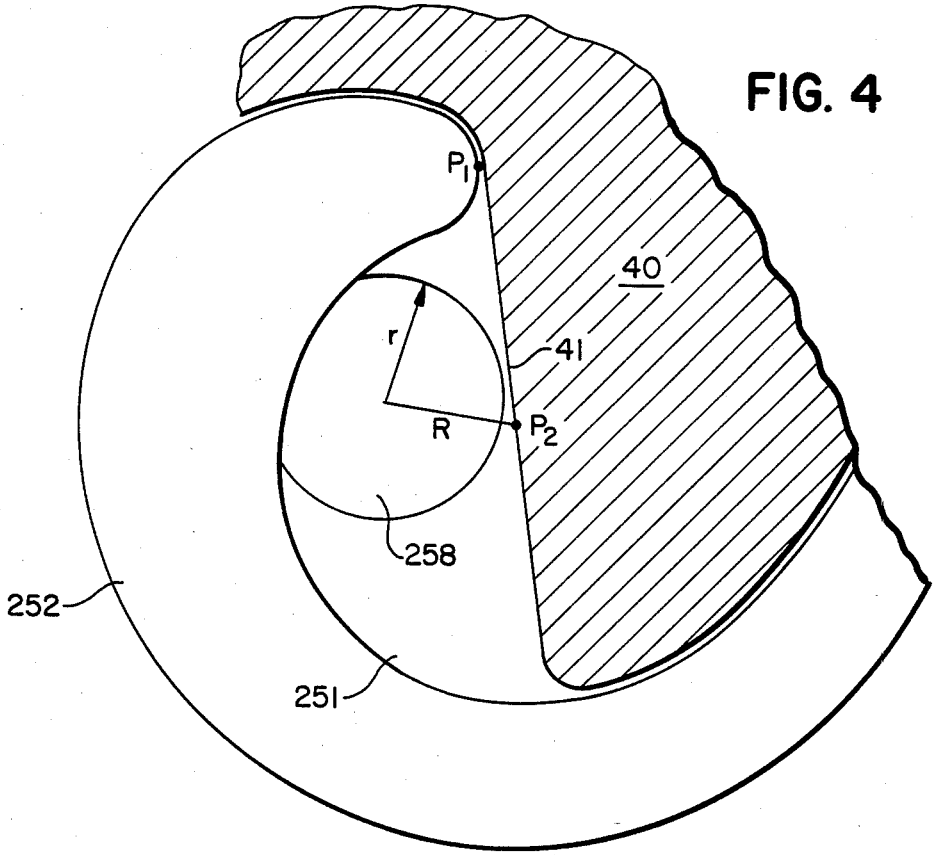

In another embodiment, the radially end portion 41 may be formed by only tangent line $P_1$–$P_2$ of a circle having radius R, as shown in FIG. 4.

As stated above, the radially inner end of involute plate 40 is closely placed to fluid discharge port 258, but does not cover or otherwise block port 258, so that fluid flows through the discharge port without striking against involute plate 40. Therefore, involute plate 40 is not subject to undesirable vibration and the fluid flow is not disrupted. The wear plate 40 does, however, provide a hardened wear surface on substantially all of the surface area of end plate 252 against which the seal element sealingly engages.

This invention has been described in detail in connection with the preferred embodiments, but these are examples only; this invention is not restricted thereto. It will be easily understood by those skilled in the art that other variations and modifications can be easily made within the scope of this invention, which is defined by the following claims.

We claim:

1. In a scroll-type fluid displacement apparatus including an orbiting scroll and a stationary scroll each having an end plate and a spiral wrap extending from one side of said end plate, said spiral wraps interfitting at an angular and radial offset to make a plurality of line contacts between the spiral curved surfaces, which define fluid pockets, and drive means operatively connected to said orbiting scroll for orbiting said orbiting scroll relative to said stationary scroll while preventing rotation of said orbiting scroll to thereby change the volume of said fluid pockets, said scrolls each having a seal element disposed on its axial end surface, and a discharge port formed through said end plate of one of said scrolls at a position near the center of said spiral element of said scroll, the improvement comprising:

said one scroll having a flat, spiral, anti-wear plate fixed to an end surface of said end plate of said scroll facing the axial end surface of said spiral wrap of said other scroll and disposed between said seal element and said end surface to prevent wear and maintain axial sealing, said anti-wear plate covering substantially only the area of the surface of said end plate where said spiral wrap and said seal element make axial contact during orbital motion of said orbiting scroll, said radially inner end of said anti-wear plate defined by a tangent of a circle centered at the center of said discharge port and having a radius greater than the radius of said discharge port, so that said radially inner end of said anti-wear plate does not cover said discharge port.

2. A scroll-type fluid displacement apparatus comprising;

a housing having a fluid inlet port and fluid outlet port;

a fixed scroll member fixedly disposed relative to said housing and having an end plate from which a first spiral wrap extends into the interior of said housing;

an orbiting scroll member having an end plate from which a second spiral wrap extends, said first and second spiral wraps interfitting at an angular and radial offset to make a plurality of line contacts defining at least one pair of sealed off fluid pockets;

a driving mechanism including a drive shaft rotatably supported by said housing to effect the orbital motion of said orbiting scroll member by the rotation of said drive shaft to thereby change the volume of said fluid pockets;

a seal element disposed on the axial end surface of said first and second spiral wraps;

a discharge port formed through said end plate of said stationary scroll at a position near the center of said spiral wrap; and at least said stationary scroll having a flat, spiral, anti-wear plate fixed to an end surface of said end plate of said stationary scroll facing the axial end surface of said spiral wrap of said orbiting scroll and disposed between said seal element and said end surface to prevent wear and maintain axial sealing, said radially inner end of said anti-wear plate defined by a tangent of a circle centered at the center of said discharge port and having a radius greater than the radius of said discharge port, so that said radially inner end of said anti-wear plate does not cover said discharge port.

3. In a scroll-type fluid displacement apparatus including an orbiting scroll and a stationary scroll each having an end plate and a spiral wrap extending from one side of said end plate, said spiral wraps interfitting at an angular and radial offset to make a plurality of line contacts between the spiral curved surfaces, which define fluid pockets, and drive means operatively connected to said orbiting scroll for orbiting said orbiting scroll relative to said stationary scroll while preventing rotation of said orbiting scroll to thereby change the volume of said fluid pockets, said scrolls each having a seal element disposed on its axial end surface, and a discharge port formed through said end plate of one of said scrolls at a position near the center of said spiral element of said scroll, the improvement comprising:

said one scroll having a flat, spiral, anti-wear plate fixed to an end surface of said end plate of said scroll facing the axial end surface of said spiral wrap of said other scroll and disposed between said seal element and said end surface to prevent wear and maintain axial sealing, said anti-wear plate covering substantially only the area of the surface of said end plate where said spiral wrap and said seal element make axial contact during orbital motion of said orbiting scroll, said radially inner end of said anti-wear plate formed by two arc-shaped segments and a straight line segment, wherein said straight line segment is a tangent of a circle centered at the center of said discharge port and having a radius greater than the radius of said discharge port, so that said radially inner end of said anti-wear plate does not cover said discharge port.

4. The apparatus of claim 3 wherein said straight line segment comprises a segment which is a tangent of an arc having a radius R centered at the center of said discharge port, wherein R is greater than the radius of said discharge port, wherein one of said arc-shaped segments is located on the periphery of an arc of said radius R, and wherein the other of said arc-shape segments is located on an arc centered at a point on said anti-wear plate.

5. A scroll-type fluid displacement apparatus comprising:

a housing having a fluid inlet port and fluid outlet port;

a fixed scroll member fixedly disposed relative to said housing and having an end plate from which a first spiral wrap extends into the interior of said housing;

an orbiting scroll member having an end plate from which a second spiral wrap extends, said first and second spiral wraps interfitting at an angular and radial offset to make a plurality of line contacts defining at least one pair of sealed off fluid pockets;

a driving mechanism including a drive shaft rotatably supported by said housing to effect the orbital motion of said orbiting scroll member by the rotation of said drive shaft to thereby change the volume of said fluid pockets;

a seal element disposed on the axial end surface of said first and second spiral wraps;

a discharge port formed through said end plate of said stationary scroll at a position near the center of said first spiral wrap; and at least said stationary scroll having a flat, spiral, anti-wear plate fixed to an end surface of said end plate of said stationary scroll facing the axial end surface of said spiral wrap of said orbiting scroll and disposed between said seal element and said end surface to prevent wear and maintain axial sealing, said radially inner end of said anti-wear plate formed by two arc-shaped segments and a straight line segment, wherein said straight line segment is a tangent of a circle centered at the center of said discharge port and having a radius greater than the radius of said discharge port, so that said radially inner end of said anti-wear plate does not cover said discharge port.

6. The apparatus of claim 5 wherein said straight line segment comprises a segment which is a tangent of an arc having a radius R centered at the center of said discharge port, wherein R is greater than the radius of said discharge port; wherein one of said arc-shaped segments is located on the periphery of an arc of said radius R; and wherein the other of said arc-shaped segments is located on an arc centered at a point on said anti-wear plate.

* * * * *